US006629078B1

(12) United States Patent
Grill et al.

(10) Patent No.: US 6,629,078 B1
(45) Date of Patent: Sep. 30, 2003

(54) APPARATUS AND METHOD OF CODING A MONO SIGNAL AND STEREO INFORMATION

(75) Inventors: Bernhard Grill, Lauf (DE); Bodo Teichmann, Nürnberg (DE); Karlheinz Brandenburg, Erlangen (DE)

(73) Assignee: Fraunhofer-Gesellschaft zur Forderung der angewandten Forschung e.V., Munich (DE)

( * ) Notice: Subject to any disclaimer, the term of this patent is extended or adjusted under 35 U.S.C. 154(b) by 0 days.

(21) Appl. No.: 09/445,894

(22) PCT Filed: Jun. 15, 1998

(86) PCT No.: PCT/EP98/03605

§ 371 (c)(1),
(2), (4) Date: Dec. 13, 1999

(87) PCT Pub. No.: WO99/17587

PCT Pub. Date: Apr. 8, 1999

(30) Foreign Application Priority Data

Sep. 26, 1997 (DE) ..... 197 42 655

(51) Int. Cl.[7] ..... H04S 1/00
(52) U.S. Cl. ..... 704/500; 704/220; 381/2
(58) Field of Search ..... 704/500, 220, 704/219, 200, 201, 203, 204; 381/23, 2; 700/94

(56) References Cited

U.S. PATENT DOCUMENTS 5,701,346 A * 12/1997 Herre et al. ..... 381/18
5,973,739 A * 10/1999 Nilsson ..... 375/240.1
6,345,246 B1 * 2/2002 Moriya et al. ..... 704/219

OTHER PUBLICATIONS

ISO/JTC1/SC29/N1903TF, Information Technology—Coding of Audiovisual Objects, Part 3: Audio, Subpart 4: Time/Frequency Coding, pp. 88–154, Oct, 31, 1997.*

* cited by examiner

*Primary Examiner*—Marsha D. Banks-Harold
*Assistant Examiner*—Donald L. Storm
(74) *Attorney, Agent, or Firm*—Glenn Patent Group; Michael A. Glenn; Kirk D. Wong

(57) ABSTRACT

A method of coding a time-discrete stereo signal, the stereo signal having a first and a second channel, permits scalable stereo coding. At first, a mono signal is formed from the stereo signal, which is then coded, whereupon the coded mono signal is transmitted to a bit stream. Thereafter, the coded mono singal is decoded again, whereupon stereo information is formed on the basis of the coded/decoded mono signal and the first and second channels, with such stereo information being coded and being also written into the bit stream in order to obtain a bit stream comprising a complete coded monolayer as well as a layer with coded stereo information.

14 Claims, 5 Drawing Sheets

APPARATUS AND METHOD OF CODING A MONO SIGNAL AND STEREO INFORMATION

FIELD OF THE INVENTION

The present invention relates to scalable audio coders and in particular to methods of and apparatus for coding a time-discrete stereo signal.

DESCRIPTION OF BACKGROUND ART

Scalable audio coders are coders of modular construction. There are endeavors to employ existing voice coders capable of processing signals, which are sampled e.g. with 8 kHz, and of outputting data rates of, for example, 4.8 to 8 kilobit per second. These known coders, such as e.g. the coders G.729, G.723, FS1016 and CELP known to experts or parametric models of MPEG-4-Audio-VM, serve mainly for coding speech signals and in general are not suitable for coding higher-quality music signals since they are usually designed for signals sampled with 8 kHz, so that they can code only an audio bandwidth of 4 kHz at maximum. However, in general they exhibit fast operation and low arithmetic expenditure.

For audio coding of music signals, in order to obtain for example HIFI quality or CD quality, a scalable coder thus employs a combination of a voice coder and an audio coder that is capable of coding signals with a higher sampling rate, such as e.g. 48 kHz. It is of course also-possible to replace the above-mentioned voice coder by a different coder, for example a music/audio coder according to the standards MPEG1, MPEG2 or MPEG3.

Such a cascade connection of a voice coder with a higher-grade audio coder usually employs the method of differential coding in the time domain. An input signal having e.g. a sampling rate of 48 kHz is downsampled to the sampling frequency suitable for the voice coder by means of a downsampling filter. The downsampled signal is then coded. The coded signal can be fed directly to a bit stream formatting means for transmission thereof. However, it contains only signals with a bandwidth of e.g. 4 kHz at maximum. The coded signal, furthermore, is decoded again and upsampled by means of an upsampling filter. However, due to the downsampling filter, the signal then obtained contains only useful information with a bandwidth of e.g. 4 kHz. Furthermore, it is to be noted that the spectral content of the upsampled coded/decoded signal in the lower band range up to 4 kHz does not correspond exactly to the first 4 kHz band of the input signal sampled with 48 kHz, since coders in general introduce coding errors.

As was already pointed out, a scalable coder comprises both a generally known voice coder and an audio coder that is capable of processing signals with higher sampling rates. In order to be able to transmit signal components of the input signal whose frequencies are above 4 kHz, a difference is formed of the input signal with 8 kHz and the coded/decoded upsampled output signal of the voice coder for each individual time-discrete sampling value. This difference then may be quantized and coded by means of a known audio coder, as known to experts. It is to be noted here that the differential signal fed into the audio coder capable of coding signals with higher sampling rates, is much lower than the original in the lower frequency range, leaving apart coding errors of the voice coder. In the spectral range above the bandwidth of the upsampled coded/decoded output signal of the voice coder, the differential signal substantially corresponds to the true input signal sampled with e.g. 48 kHz.

In the first stage, i.e. the stage of the voice coder, a coder with low sampling frequency is thus used mostly, since in general a very low bit rate of the coded signal is aimed at. At present, there are several coders, also the coders mentioned, operating with bit rates of a few kilobit (two to eight kilobit or also above). The same coders, furthermore, permit a maximum sampling frequency of 8 kHz, since a greater audio bandwidth is not possible anyway with such a low bit rate and since coding with a low sampling frequency is more advantageous as regards the arithmetic expenditure. The maximum possible audio bandwidth is 4 kHz and in practical application is restricted to about 3.5 kHz. In case a bandwidth improvement is to be achieved now in the additional stage, i.e. in the stage including the audio coder, this additional stage will have to operate with a higher sampling frequency. For matching the sampling frequencies, decimation and interpolation filters are used for downsampling and upsampling, respectively.

However, so far only scalable coders for mono signals are known or implemented. However, it would be desirable to have a conception for scalable audio coders having joint-stereo capabilities. "Joint-stereo" is understood as stereo coding techniques, such as e.g. mid/side coding (M/S coding) or intensity-stereo coding (IS coding). When a separate scalable mono audio coder each is just employed for the left-hand (L) and right-hand (R) channels of a stereo signal, coding of a stereo signal is indeed possible, but coding does not take any account of joint-stereo techniques which may open up extensive saving possibilities in bit-saving coding of stereo signals.

SUMMARY OF THE INVENTION

It is the object of the present invention to make available a method of and an apparatus for coding a time-discrete stereo signals, which permit the utilization of joint-stereo techniques.

In accordance with a first aspect of the present invention, this object is met by a method of coding a time-discrete stereo signal, with the stereo signal having a first and a second channel, said method comprising the following steps: forming a mono signal from the stereo signal; coding the mono signal and transmitting the coded mono signal to a bit stream; decoding the coded mono signal; forming stereo information on the basis of the coded/decoded mono signal and the first and second channels; and coding the stereo information and transmitting the same to the bit stream.

In accordance with a second aspect of the present invention, this object is met by an apparatus for coding a time-discrete stereo signal, the stereo signal having a first and a second channel, said apparatus comprising: a device for forming a mono signal from the stereo signal; a mono coder for coding the mono signal and transmitting the coded mono signal to a bit stream; a mono decoder for decoding the coded mono signal; a device for forming stereo information on the basis of the coded/decoded mono signal and the first and second channels; and a stereo coder for coding the stereo information and for transmitting the same to the bit stream.

The present invention is based on the realization that a combination of joint-stereo techniques with the principle of scalability can be obtained when a mono signal is formed first, of the left-hand and right-hand channels of a stereo signal, which preferably can take place by summation. The mono signal is coded by means of a first coder, whereupon the signal resulting therefrom is fed to a bit stream multiplexer. The coded mono signal furthermore is decoded again in order to obtained a coded/decoded mono signal which differs from the original mono signal in that it has coding errors introduced by the first coder. From this coded/decoded mono signal and the left-hand and right-hand channels of the time-discrete stereo signal, items of stereo information can be produced which, for example, may be mid/side (M/S) information or intensity-stereo (IS) information or, under certain circumstances, also the original left-hand channel or the original right-hand channel. As will become apparent in the following, the coded/decoded mono signal itself or the difference of the original mono signal from the coded/decoded mono signal can also be used as stereo information in order to provide, together with the difference of left-hand and right-hand channels, which is also referred to as S signal, directly mid/side coding. The stereo information, by way of a second coder having the same construction as the first coder or a construction different from the first coder, can now be coded and also be fed to a bit stream multiplexer generating a bit stream from the coded mono signal and the coded stereo information as well as from the side information necessary for subsequent decoding.

The formation of the mono signal and coding thereof can take place in the time domain, when e.g. a voice coder is used as first coder or core coder. The formation and coding of stereo information preferably takes place in the frequency domain as recourse can then be taken to powerful coders operating in accordance with the psychoacoustic model.

However, it is also possible, prior to further processing, to transform the right-hand and left-hand channels to the frequency domain, with the result that a frequency domain coder can also be employed for coding the mono signal, which is capable of coding in as distortion-free manner as possible using the psychoacoustic model.

If for the first coder, i.e. for the coder for the mono signal, a coder is employed having a lower sampling rate than the time-discrete stereo signal to be coded, the mono signal formed from summation of the left-hand and right-hand channels must first be transformed to the lower sampling frequency, which is also referred to as downsampling. The mono signal transformed to the lower sampling frequency then is coded and decoded again, with the coded/decoded mono signal also having the lower sampling frequency. The coded/decoded mono signal, for permitting correlation thereof with the left-hand and right-hand channels sampled at a higher rate so as to provide stereo information, must be converted again to the sampling frequency of the time-discrete stereo signal, which is also referred to as upsampling. If this coded/decoded mono signal obtained by upsampling is subjected to frequency domain transformation, which prefereably may be implemented as MDCT (MDCT=modified discrete cosine transformation), the resulting transformed coded/decoded mono signal has the same time and frequency resolution as the original time-discrete stereo signal, i.e. the left-hand (L) and the right-hand (R) channel.

If, in constrast thereto, the first coder is operated with the same sampling rate as that inherent the time-discrete stereo signal, downsampling and upsampling of course can be dispensed with.

BRIEF DESCRIPTION OF THE DRAWINGS

Preferred embodiments of the present invention will be elucidated in more detail hereinafter with reference to the attached drawings in which.

DETAILED DESCRIPTION OF THE PREFERRED EMBODIMENTS

Figure 1:
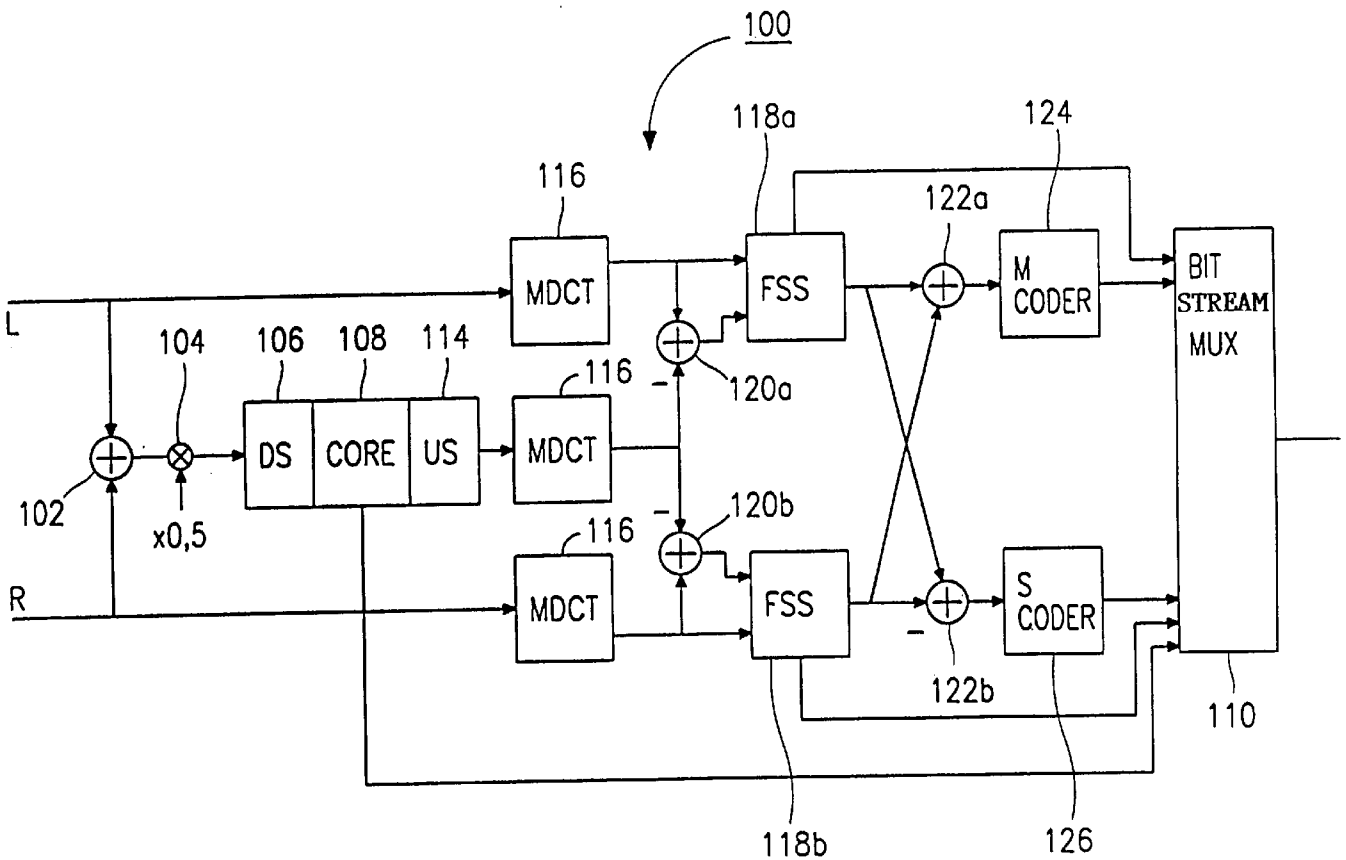
FIG. 1 shows a scalable stereo coder with mono signal formation and coding in the time domain and mid/side coding in the frequency domain in accordance with a first embodiment of the present invention.

FIG. 1 shows a principle block diagram of a scalable stereo coder 100 according to a first embodiment of the present invention. The scalable stereo coder receives a time-discrete stereo signal comprising a first or left-hand channel L and a second or right-hand channel R. From the stereo signal, a sum signal is formed first, preferably by summation according to sampling values by means of a summation means or summator 102, said sum signal being then multiplied by a multiplier 104 by the factor 0.5 in order to generate in the present embodiment a mono signal identical with the mid signal known from M/S coding. The mono signal at the output of multiplier 104 is fed into a downsampling filter 106 in order to transform the sampling rate thereof to a preferably lower sampling rate which permits coding of the mono signal by means of a time domain coder which is part of the core codec 108. The coded mono signal, together with corresponding side information, is written into a bit stream multiplexer 110 generating at the output 112 thereof a bit stream which is a coded representation of the time-discrete stereo signal.

Within the core codec 108, the coded mono signal is decoded again so as to be converted again to the first sampling rate by means of an upsampling filter 114, so that the coded/decoded mono signal can be correlated with the left-hand and right-hand channels for subsequent generation of stereo information.

The time-discrete sampling signal, for example, could have been sampled by means of a first sampling rate, e.g. 48 kHz. The downsampling filter 106 could convert this signal with the first sampling rate to a second sampling rate of e.g. 8 kHz. The first and second sampling rates preferably constitute a ratio of an integer. The downsampling filter 106 may be implemented, for example, as decimation filter. The core codec 108 could comprise, for example, a voice coder, such as e.g. G.729, G.723, FS1016, MPEG-4 CELP, MPEG-4 PAR or the like coder. Such coders operate at data rates of 4.8 kilobit per second (FS1016) to data rates of 8 kilobit per second (G.729). However, it is apparent to experts that arbitrary other coders with other data rates or other sampling frequencies could be used as core codec 108 as well.

If a core codec is used as coder operating at 8 kHz, the coded mono signal has a maximum bandwidth of 4 kHz, since the downsampling filter 106 has converted the mono signal. e.g. by decimation, to a sampling frequency of 8 kHz. Within the bandwidth of 0 to 4 kHz, the coded/decoded mono signal and the original mono signal then are identical at the input of downsampling filter 106, except for coding errors introduced by core codec 108. However, it is to be pointed out that the coding errors introduced by core codec 108 are not always minor errors, but may easily reach the orders of magnitude of the useful signal, for example, when a highly transient signal is coded in the first coder. As will be elucidated in more detail hereinafter, it is therefore examined whether differential coding makes sense at all.

The output signal of upsampling filter 114, just as the left-hand and the right-hand channel, now is also converted to the frequency domain by means of MDCT filter banks 116. The output signals of MDCT filter banks 116, as shown in FIG. 1, are supplied to a first frequency-selective switching means (FSS) 118*a* and to a second frequency-selective switching means 118*b*, respectively, which takes place directly and, respectively, indirectly via a first summator 120*a* or a second summator 120*b*.

In particular, the output signal of the MDCT filter bank for the left-hand channel is supplied to the first frequency-selective switching means (FSS) 118*a* which is also fed with the sum of the transformed left-hand channel and the transformed coded/decoded mono signal with negative sign. The second frequency-selective switching means 118*b*, in addition to the transformed R channel, receives the sum of the transformed R channel and of the coded/decoded mono signal with negative sign.

The frequency-selective switching means 118*a*, 118*b* examine whether it is more favorable to further process the transformed original left-hand or right-hand signal or the difference between the left-hand or right-hand signal and the coded/decoded mono signal, respectively. The function of the frequency-selective switching means will be shown in more detail hereinafter.

The output signal of the first frequency-selective switching means 118*a* is supplied both to a third summator 122*a* and to a fourth summator 122*b* with positive sign, while the output signal of the second frequency-selective switching means 118*b* is supplied to the third summator 122*a* with positive sign and to the fourth summator 122*b* with negative sign. Present at the output of third summator 122*a* then is either the sum of the transformed left-hand or right-hand channels or the difference of the sum of the encoded left-hand and right-hand channels and the coded/decoded sum of the left-hand and right-hand channels. This signal, which in contrast to the coded mono signal of core codec 108 now has stereo information, is coded by means of an M coder 124, considering e.g. the psychoacoustic model, and is fed to bit stream multiplexer 110.

In contrast thereto, the difference of the transformed left-hand and right-hand channels is present at the output of fourth summator 124*b*, with this signal being also referred to as side signal in the field of technology and being fed to an S coder 126, with the S coder 126, just like the M coder 124, being also capable of coding in consideration of the psychoacoustic model. The output signal of S coder 126 also is fed to the bit stream multiplexer and also comprises stereo information with respect to the time-discrete stereo signal at the input of the scalable stereo coder 100 according to the first embodiment of the present invention. It is obvious to experts that a complete bit stream requires side information. Side information relevant for the invention is, in particular, information of the frequency-selective switching means 118*a* and 118*b* with respect to the fact as to in which frequency band differential signals or transformed L or R signals were output to third summator 122*a* and fourth summator 122*b*, respectively.

In the following, the functions of individual components shall be eliminated in more detail if these have not yet been set forth hereinbefore.

The output signal of core codec 108, as mentioned hereinbefore, has a sampling frequency of e.g. 8 kHz. This signal, i.e. the mono signal, with lower sampling rate than the original time-discrete stereo signal, however, is to be correlated now with the left-hand and right-hand channels, respectively, in order to provide stereo information. For obtaining comparable signals, the signal with lower sampling rate thus must be converted to a signal having the same sampling rate as the time-discrete stereo signal.

This can be effected by inserting a specific number of zero values between the individual time-discrete sampling values of the coded/decoded mono signal at the output of core codec 108. The number of zero values is calculated on the basis of the ratio of the first and second sampling frequencies. The ratio of the first (high) sampling frequency to the second (low) sampling frequency is referred to as upsampling factor. As is known, the introduction of zeros, which is possible with very little arithmetic expenditure, brings about an aliasing error having the effect that the low-frequency or zero spectrum of the coded/decoded mono signal is repeated at the output of core code 108, as many times as there were zeros inserted. The aliasing-inflicted filter then is transformed to the frequency domain by means of MDCT filter bank 116. By inserting e.g. 5 zeros between each sampling value, a signal is generated of which it is known from the very beginning that only every sixth sampling value of this signal is different from zero. This fact can be utilized in transforming this signal to the frequency domain by means of a filter bank or a modified discrete cosine transformation or by means of an arbitrary frequency transformation, since it is possible e.g. to dispense with certain summations occurring in simple FFT. The structure of the signal to be transformed, which is known from the very beginning, thus can be employed in advantageous manner for saving calculating time when transforming said signal to the frequency domain.

The coded/decoded mono signal unsampled to the first sampling frequency is only in the lower frequency band a correct representation of the original mono signal at the output of multiplier 104, and this is why at maximum only unity/unsampling-factor times of the entire spectral lines is used at the output of MCDT filter bank 116. The insertion of zeros into the coded/decoded mono signal at the output of core codec 108, however, has the effect that the spectral representation of the coded/decoded mono signal then has the same time and frequency resolution as the transformed left-hand and right-hand channels.

It is not always favorable to employ differential processing subsequent to the frequency-selective switching means 118*a* and 118*b*. The frequency-selective switching means thus perform so-called simulcast differential switching. For example, it is not favorable to further process a differential signal if the differential signal displays higher energy than the corresponding other signal at the input of frequency-selective switching means 118*a*. Due to the fact that an arbitrary coder may be used as core codec 108, it may happen that the coder produces certain signal components that are difficult to be coded by M coder 124 and S coder 126, respectively. Core codec 108 preferably is to maintain phase information of the signal coded by the same, which among experts is referred to as "waveform coding" or "signal form coding". The decision carried out by frequency-selective switching module 118*a* or 118*b* preferably is performed as a function of the frequency.

"Differential coding" means that only the difference of the transformed left-hand or right-hand channel and of the transformed coded/decoded mono signal is coded. However, if such differential coding is not favorable as the energy content of the differential signal is higher than the energy content of the transformed left-hand or right-hand signal, differential coding is refrained from, and it is switched to simulcast operation.

Due to the fact that the formation of the difference takes place in the frequency domain, i.e. selectively by spectral values, it is easily possible to perform frequency-selective simulcast or differential coding. The formation of the difference in the spectrum thus permits a simple, frequency-selective choice of the frequency ranges to be subjected to differential coding. In principle, switching over from differential to simulcast coding could occur for each spectral value individually. However, this would require a too large amount of side information. It is thus preferred to carry out a comparison, e.g. according to frequency groups, of the energies of the differential spectral values and of the transformed left-hand or right-hand channel, respectively. As an alternative, specific frequency bands can be determined from the very beginning, e.g. 8 bands of 500 kHz each in the embodiment. A compromise in the determination of the frequency bands consists in balancing the amount of side information to be transmitted, i.e. whether or not differential coding is active in a frequency band, against the benefit arising from differential coding as often as possible.

The formation of stereo information on the basis of the coded/decoded mono signal and the first and second channels thus comprises a determination as to where it is more favorable to process either the transformed left-hand or right-hand channel or a difference thereof and of the coded/decoded mono signal. In each frequency band chosen, a frequency-selective comparison of the respective energies is carried out then. In case the energy in a specific frequency band of the differential signal exceeds the energy of the other signal multiplied by a predetermined factor k, it is determined that the output signal of the frequency-selective switching means 118*a* is the original transformed left-hand signal. Otherwise, a determination is made to the effect that the differential spectral values are output. Factor k may be in a range, for instance, from approx. 0.1 to 10. With values of k smaller than 1, simulcast coding is already employed when the differential signal displays lesser energy than the other signal. In contrast thereto, in case of values of k greater than 1, differential coding still is employed, even if the energy content of the differential signal is already greater than that of the original left-hand or right-hand channel. As an alternative to the formation of the difference described, the formation of stereo information can also be performed such that e.g. a ratio or other correlation of the coded/decoded mono signal and of the transformed left-hand or right-hand channel is implemented.

Figure 2A:
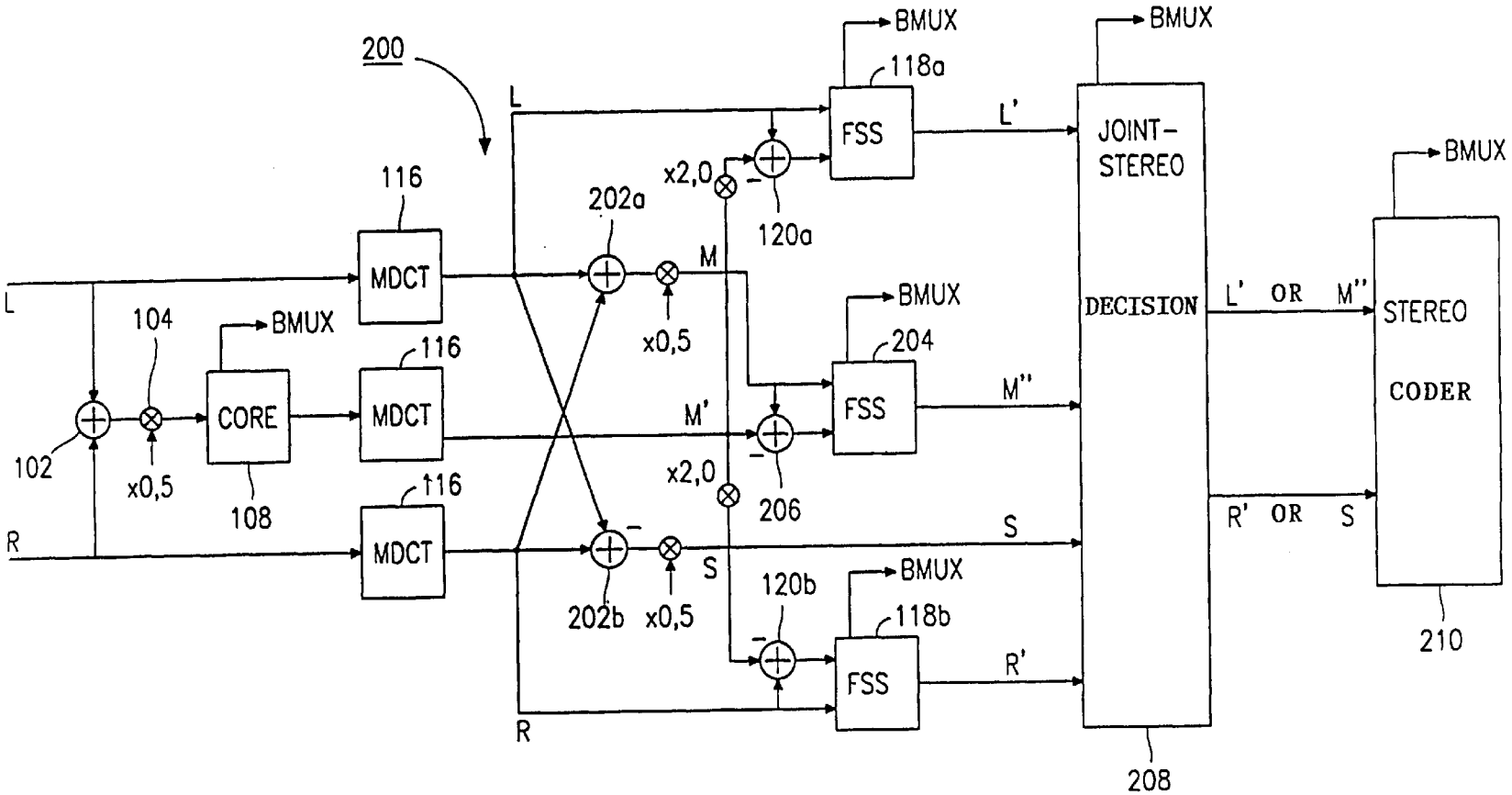
FIG. 2A shows a scalable stereo coder with mono signal formation and coding in the-time domain and L/R or M/S coding in the frequency domain in accordance with a second embodiment.

FIG. 2A illustrates a scalable stereo coder 200 according to a second embodiment of the present invention. Like elements bear the same reference numerals and will not be described again if they display the same behavior. Scalable stereo coder 200 differs from scalable stereo coder 100 according to the first embodiment of the invention in essence in that mid/side coding or L/R coding can be carried out selectively.

To this end, the scalable stereo coder 200 comprises further summation means 202*a*, 202*b* for generating a mid signal M and a side signal S from the transformed left-hand and right-hand channels, respectively. The transformed coded/decoded mono signal is referred to as M' here. Signal M and signal M' are supplied to an also additional frequency-selective switching means 204 which generates a signal M", with the frequency-selective switching means 204 also having a summator 206 connected upstream thereof, which holds also for all other frequency-selective switching means. Scalable stereo coder 200 comprises furthermore a block designated joint-stereo decision 208, receiving four input signals L', M", S and R'. The block joint-stereo decision 208 decides in known manner whether a stereo coder 210 is to carry out L/R, M/S or intensity coding.

The function of scalable stereo coder 200 shall be pointed out in the following. At first, a mono signal is formed of the time-discrete stereo signal, with this formation taking place in the time domain and reading as follows in an equation:

$$M_T=(L+R)\cdot 0.5 \qquad \text{(Equation 1)}$$

The index T is to indicate that a mid signal in the time domain is involved here. The core coder 108 then operates as was pointed out in conjunction with FIG. 1. Furthermore, as in FIG. 1, MDCT is carried out on signals L and R as well. By means of summators 202*a* and 202*b* as well as the downstream multipliers, the M/S signal is then calculated in the frequency domain, which can be expressed as follows in equations:

$$M=(L+R)\cdot 0.5 \qquad \text{(Equation 2)}$$

and $$S=(L-R)\cdot 0.5 \qquad \text{(Equation 3)}$$

As was already pointed out, the frequency-selective switching means serves to calculate M". M" either is equal to M−M' or M itself, as has already been indicated. The frequency-selective switching means 118 calculates signal L' which is either equal to 0.5·(L−M') or equal to 0.5·L. The same holds in corresponding manner for signal R', which is either equal to R·0.5 or equal to (R−M')·0.5. The switching means 118*a*, 118*b* and 204 operate in frequency-selective manner. In block joint-stereo decision 208, a decision is made in usual manner as to whether coding of the signals L' and R' or M" or S has to be effected. This function is known in the art and thus will not be elucidated in more detail.

Figure 2B:
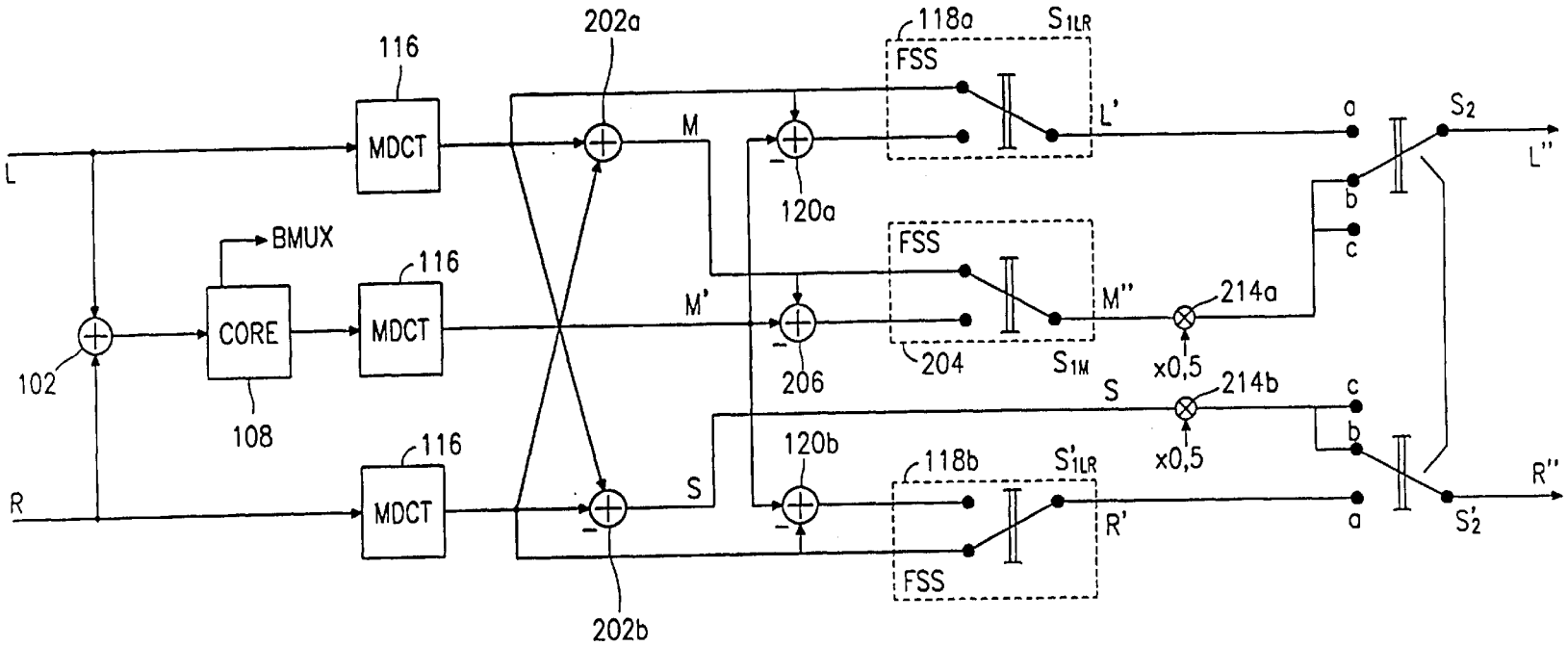
FIG. 2B shows a more detailed representation of the scalable stereo coder of FIG. 2A.

FIG. 2B shows a scalable stereo coder differing in some aspects from the scalable stereo coder 200 according to the second embodiment of the invention. Said stereo coder comprises as sole multipliers the two multipliers 214*a* and 214*b* disposed downstream of the frequency-selective switching means 204 and downstream of the frequency-selective switching means 118*b*, respectively. FIG. 2B comprises furthermore a somewhat more detailed representation of the frequency-selective switching means. The switching state of frequency-selective switching means 118*a*, which is designated $S_{1LR}$, will always be complementary to the switching state of frequency-selective switching means 118*b*, which is designated $S'_{1LR}$. The same holds for two additional switches $S_2$ and $S_2'$ which may be provided in block joint-stereo decision 208 in order to provide internal signals L" and R".

Shifting of the multiplications to behind the frequency-selective switching means provides a simpler and clearer representation of the stereo coder. The multiplications as such, thus, do no longer become absolutely necessary, but the same can also be carried out in the decoder. For reducing the side information to be transmitted, it is possible furthermore, instead of transmission of all switch states, to transmit just a few switch states. If switch $S_2$ displays state a, indicating that L/R coding is employed, it is sufficient to just transmit the state of switches $S_1$, $S'_1$, in which the transmission of the state of switch $S'_1$, can be dispensed with since the latter will be complementary to the state of switch $S_1$. If switch $S_2$ takes a different state, i.e. state b, as shown in the drawing, it is sufficient to transmit the state $S_{1M}$ of frequency-selective switching means 204, which indicates whether differential coding or simulcast coding of signal M is carried out. In case switch $S_2$ is in a position c, the fact that intensity-stereo coding is employed is transmitted as side information, with the position of switch $S_{1M}$ being transmitted in this case as well, whereas the positions of $S_{1LR}$ and $S'_{1LR}$ are insignificant here.

Figure 3:
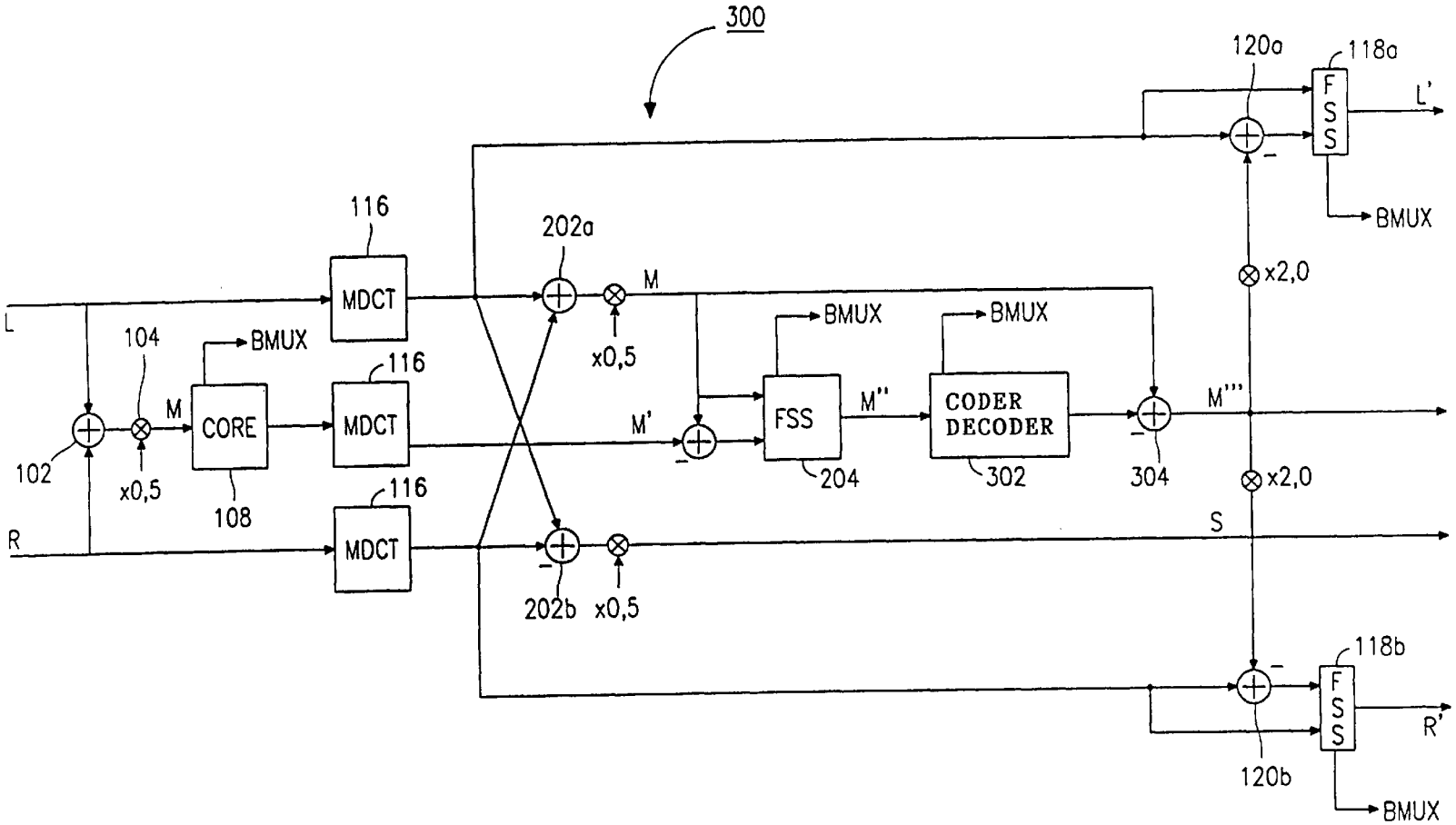
FIG. 3 shows an extended representation of the scalable stereo coder shown in FIG. 2A, in accordance with a third embodiment of the present invention.

FIG. 3 comprises an additional embodiment 300 of a scalable stereo coder according to the present invention. The embodiment shown in FIG. 3 differs from the embodiment shown in FIG. 2 in essence in that the mono signal is coded in two stages. The first stage is constituted by core codec 108, whereas the second stage is constituted by a coder/decoder 302 which, in the preferred embodiment, operates in the frequency domain and may be designed as psychoacoustic frequency domain coder. The coder/decoder 302 receives as input signal M" the output signal of the frequency-selective switching means 204, and in this case, too, an examination is made as to whether or not differential or simulcast coding makes sense. The output signal of coder/decoder 302 is fed to a summator 304 the output signal M'" of which corresponds to the difference between the signal M and the output signal of coder/decoder 302. This signal M'", just as signals L', S and R', is supplied to a joint-stereo decision (not shown) and then to a stereo coder (not shown either). Core codec 108, just like coder/decoder 302, has an output to the bit stream multiplexer, in order to transmit coded data thereto. The outputs of the frequency-selective switching means to the bit stream multiplexer are to illustrate that side information of the frequency-selective switching means, concerning the use of differential and simulcast coding in a frequency band, must also be fed to the bit stream multiplexer in order to render possible interference-free decoding. In case of stereo coder 300 depicted in FIG. 3, the bit stream, in addition to the first layer constituted by the coded mono signal of core codec 108, comprises a second layer constituted by coded signal M" at the bit stream multiplexer output of coder/decoder 302, with the coder 300 of FIG. 3 being also capable of rendering possible coding of the mono signal with the full sampling rate.

Figure 4:
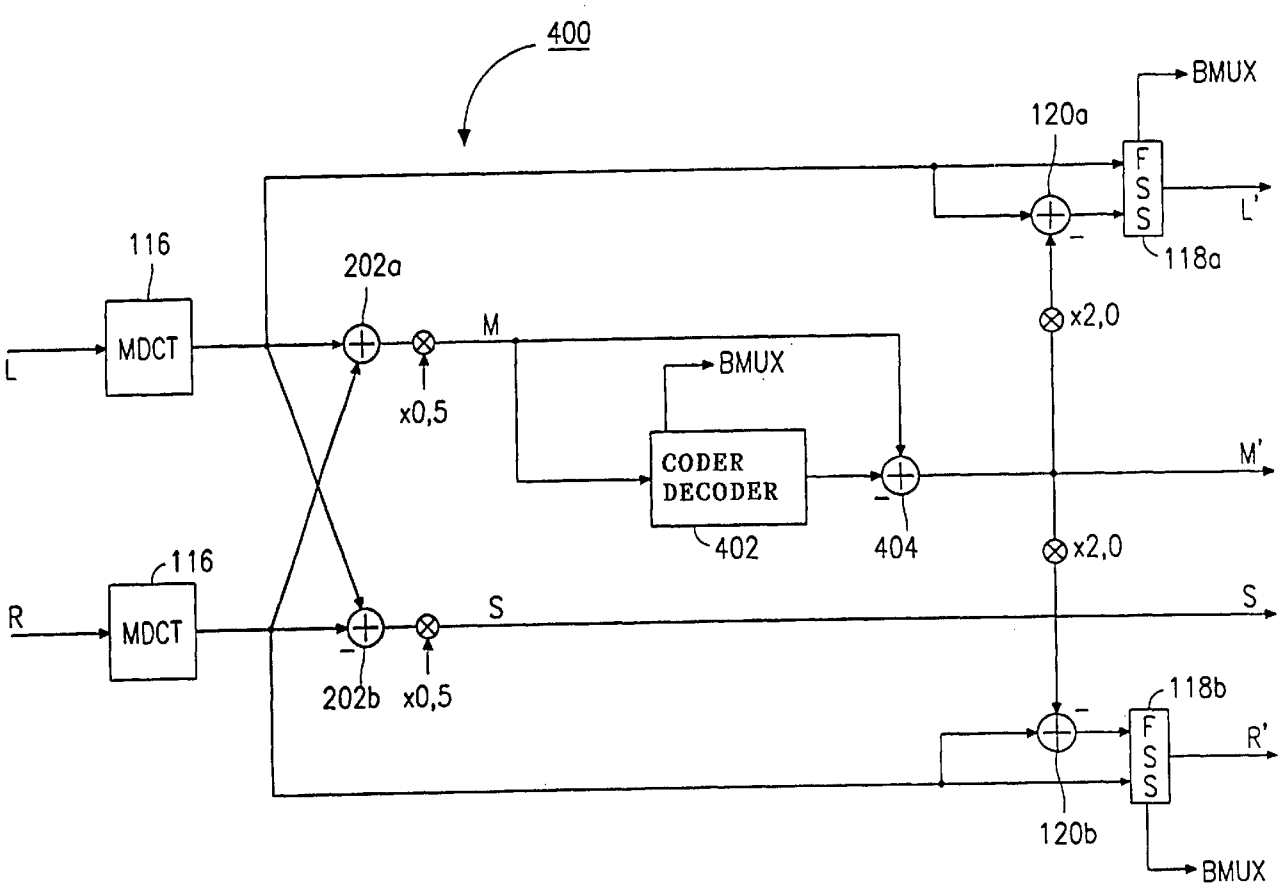
FIG. 4 shows a scalable stereo coder with mono signal formation in the time domain and selective L/R or M/S coding in the frequency domain.

In contrast to the embodiments shown so far, FIG. 4 depicts a scalable audio coder 400 which forms a mono signal in the frequency domain only. To this end, signals L and R are transformed to the frequency domain by means of MDCT filter banks 116, whereupon an M/S matrix is implemented by means of summators 202*a* and 202*b* and the subsequent multipliers with a factor 0.5. At the output of the multipliers, there are thus present a mid signal M on the one hand and a side signal S on the other hand. The mid signal, which may be used as mono signal, is coded and decoded again by means of a first coder/decoder 402, with the coded mono signal M being written into the bit stream, as was already indicated repeatedly hereinbefore. Connected downstream of coder/decoder 402 is a summation means 404 forming the difference between the coded/decoded mono signal and the original mono signal M, with this difference being referred to as M'. Signals L', M', S and R' again can be supplied to a joint-stereo decision means which, however, it not shown in FIG. 4.

The coder 400 presented in FIG. 4 thus operates completely within the frequency domain, with coder/decoder 402 being preferably designed as frequency domain coder with full sampling rate. The stereo coder (not shown) subsequent to the IS decision stage (in FIG. 4 not shown either) preferably is also designed as frequency domain coder with full sampling rate. The scalable stereo coder shown in FIG. 4 thus represents a generalization of the term "scalability", since the bit stream in this case has no layers with different audio bandwidths, but (like the other embodiments) comprises a monolayer and a stereolayer which may be coded separately from each other by means of a coder. An earlier mono decoder, not equipped for stereo operation, thus can be used, for example, for decoding the bit stream of the coders according to the invention, so as to generate at least a mono audio signal. The scalable stereo coders according to the invention thus are reverse-compatible with respect to existing mono decoders.

What is claimed is:

1. A method of coding a time-discrete stereo signal, the stereo signal having a first channel and a second channel, said method comprising the following steps:

(a) forming a mono signal from the first channel and the second channel;

(b) coding the mono signal to obtain a coded mono signal and transmitting the coded mono signal to a bit stream;

(c) decoding the coded mono signal to obtain a coded/decoded mono signal;

(d) forming stereo information on the basis of the coded/decoded mono signal and the first channel and the second channel; and (e) coding the stereo information to obtain coded stereo information and transmitting the coded stereo information to the bit stream.

2. The method of claim 1, in which the time-discrete stereo signal has a first sampling rate, wherein step (a) comprises the following partial steps:

(a21) summing the first and the second channel by sampling values in order to obtain a sum signal; and (a22) converting the sum signal to a second sampling rate lower than the first sampling rate in order to obtain the mono signal; and wherein step (c) comprises the following partial steps:

(c21) decoding the coded mono signal having the second sampling rate to obtain the coded/decoded mono signal; and (c22) converting the coded/decoded mono signal to the first sampling rate.

3. The method of claim 1, further comprising the following step:

transforming the first channel and the second channel and the coded/decoded mono signal to a frequency domain to obtain transformed signals, the transformed signals all having substantially the same time and frequency resolution.

4. The method of claim 3, wherein step (d) comprises the following partial steps:

(d41) frequency-selectively comparing of the transformed first channel to a difference of the transformed first channel and the transformed coded/decoded mono signal, and selecting the signal having a lower entropy in terms of hearing or a lower energy or adapted to be coded with a lower bit number;

(d42)frequency-selectively comparing of the transformed second channel to the difference of the transformed second channel and the transformed coded/decoded mono signal, and selecting the signal having a lower entropy in terms of hearing or a lower energy or adapted to be coded with a lower bit number;

(d43) summing signals selected in steps (d41) and (d42) in order to obtain a mid signal as first stereo information; and (d44) subtracting a signal selected in step (d42) from a signal selected in step (d41) in order to obtain a side signal as second stereo information.

5. The method of claim 1, wherein step (d) comprises the following partial steps:

(d51) summing a transformed first channel and a transformed second channel in order to obtain a mid signal; and (d52) subtracting the transformed second channel from the transformed first channel in order to obtain a side signal.

6. The method of claim 5, wherein step (d) further comprises the following partial steps:

(d61) frequency-selectively comparing of the transformed coded/decoded mono signal to a difference of the mid signal and the coded/decoded mono signal, and selecting the signal with lower energy;

(d62) frequency-selectively comparing of the first channel to the difference of the first channel and the transformed coded/decoded mono signal; and (d63) frequency-selectively comparing of the second channel to the difference of the second channel and the transformed coded/decoded mono-signal.

7. The method of claim 6, wherein step (d) further comprises the following partial step:

(d71) deciding whether results of steps (d61) and (d52) or results of steps (d62) and (d63), respectively, are used as first and second stereo information.

8. The method of claim 7, wherein step (d), prior to step (d71), further comprises the following partial step:

(d81) halving the results of steps (d61) and (d52).

9. The method of claim 7, wherein step (d) further comprises the following partial step:

(d91) if in steps (d71) the results of steps (d62) and (d63) are used as first and second stereo information, transmitting side information indicating either the result of step (d62) or of step (d63), otherwise transmitting side information indicating the result of step (d61).

10. The method of claim 1, wherein step (d) further comprises the following partial steps:

(d101) frequency-selectively comparing of a mid signal to a difference of the mid signal and a transformed coded/decoded mono signal, and selecting the signal with lower energy as additional mono signal;

wherein step (b) further comprises the following steps:

(b101) coding the additional mono signal to obtain a coded additional mono signal and transmitting the coded additional mono signal to the bit stream; and (b102) decoding the coded additional mono signal to obtain a coded/decoded additional mono signal.

11. The method of claim 10, wherein step (d) comprises the following partial steps:

(d51) summing a transformed first channel and a transformed second channel in order to obtain a mid signal;

(d52) subtracting the transformed second channel from the transformed-first channel in order to obtain a side signal;

(d111) subtracting the coded/decoded additional mono signal from the mid signal;

(d112) frequency-selectively comparing of the transformed first channel to a difference of the first channel and a result of step (d111), and selecting the signal with lower energy;

(d113) frequency-selectively comparing of the transformed first channel to a difference of the second channel and the result of step (d111), and selecting the signal with the lower energy; and (d114) deciding whether results of steps (d111) and (d52) or results of steps (d112) and (d113), respectively, are used as first and second stereo information.

12. The method of claim 1, wherein prior to step (a) the first channel and the second channel are transformed to a frequency domain to obtain a transformed first channel and a transformed second channel, with step (a) comprising the following partial step:

(a121) summing the transformed first channel and the transformed second channel by spectral values in order to obtain the mono signal.

13. The method of claim 12, wherein step (d) comprises the following partial steps:

(d131) subtracting the coded/decoded mono signal from the mono signal;

(d132) subtracting the transformed second channel from the transformed first channel in order to obtain a transformed side signal;

(d133) comparing, by spectral values, the transformed first channel to a difference of the transformed first channel and a result of step (d131), and selecting the signal with lower energy;

(d134) comparing, by spectral values, the transformed second channel to a difference of the transformed second channel and the result of step (d131), and selecting the signal with lower energy; and (d135) deciding whether results of steps (d133) and (d134) or results of steps (d131) and (d132) are used as first and second stereo information.

14. An apparatus for coding a time-discrete stereo signal, the stereo signal having a first channel and a second channel, said apparatus comprising:

(a) a device for forming a mono signal from the first channel and the second channel;

(b) a mono coder for coding the mono signal to obtain a coded mono signal and transmitting the coded mono signal to a bit stream;

(c) a mono decoder for decoding the coded mono signal to obtain a coded/decoded mono signal;

(d) a device for forming stereo information on the basis of the coded/decoded mono signal and the first channel and the second channel; and (e) a stereo coder for coding the stereo information to obtain coded stereo information and for transmitting the coded stereo information to the bit stream.

* * * * *